US006938395B2

(12) United States Patent
Knight et al.

(10) Patent No.: US 6,938,395 B2
(45) Date of Patent: Sep. 6, 2005

(54) METHOD FOR CLOSING SLIDER-OPERATED ZIPPER ON FILLED RECLOSABLE POUCH

(75) Inventors: Nigel D. Knight, Kankakee, IL (US); Donald L. Crevier, Essex, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/031,387

(22) Filed: Jan. 7, 2005

(65) Prior Publication Data

US 2005/0115203 A1 Jun. 2, 2005

Related U.S. Application Data

(62) Division of application No. 10/253,852, filed on Sep. 24, 2002, now Pat. No. 6,851,248.

(51) Int. Cl.[7] ..... B65B 61/18
(52) U.S. Cl. ..... 53/412; 53/476
(58) Field of Search ..... 53/412, 476, 133.4, 53/139.2, 375.4; 493/213, 927; 29/768

(56) References Cited

U.S. PATENT DOCUMENTS

| | | | | | |
|---|---|---|---|---|---|
| 1,748,086 | A | * | 2/1930 | Small | 74/569 |
| 2,879,588 | A | * | 3/1959 | Morin | 29/408 |
| 3,629,926 | A | * | 12/1971 | Maeda | 29/768 |
| 3,701,191 | A | * | 10/1972 | Laguerre | 493/214 |
| 4,020,544 | A | * | 5/1977 | Smith et al. | 29/513 |
| 4,080,241 | A | | 3/1978 | Grevich et al. | 156/498 |
| 4,215,597 | A | | 8/1980 | Miller et al. | 81/9.1 R |
| 4,490,959 | A | | 1/1985 | Lems | 53/459 |
| 4,520,544 | A | * | 6/1985 | Morita et al. | 29/408 |
| 4,581,006 | A | | 4/1986 | Hugues et al. | 493/213 |
| 4,592,135 | A | | 6/1986 | Kando | 29/766 |
| 4,637,060 | A | | 1/1987 | Ausnit | 383/37 |
| 4,665,552 | A | | 5/1987 | Lems et al. | 383/37 |
| 4,707,901 | A | | 11/1987 | Froehlich | 29/408 |
| 4,731,922 | A | | 3/1988 | Ikehara et al. | 29/766 |
| 4,756,079 | A | | 7/1988 | Kando | 29/768 |
| 4,848,064 | A | | 7/1989 | Lems et al. | 53/459 |
| 5,154,086 | A | | 10/1992 | Porchia et al. | 73/818 |
| 5,664,406 | A | | 9/1997 | Smith | 53/459 |
| 6,148,588 | A | * | 11/2000 | Thomas et al. | 53/412 |
| 6,517,473 | B1 | * | 2/2003 | Cappel | 493/213 |
| 6,526,726 | B1 | * | 3/2003 | Strand et al. | 53/412 |
| 6,599,227 | B1 | * | 7/2003 | Kettner | 493/213 |

(Continued)

*Primary Examiner*—Louis Huynh
(74) *Attorney, Agent, or Firm*—Ostrager Chong Flaherty & Broitman PC

(57) ABSTRACT

An apparatus for closing a slider-operated zipper on a moving filled package, comprising means for performing the following steps: conveying a package forward in a straight line; guiding a slider on a zippered portion of the package through a channel as the package moves forward; blocking forward movement of the slider at a predetermined position inside the channel as the package continues to move forward; and releasing the slider when the force being exerted by the slider in the forward direction reaches a level substantially equal to a predetermined threshold. This apparatus can be employed in association with a continuous band sealing apparatus. The means for blocking forward movement of the slider at a predetermined position inside the channel are a pair of spring-loaded plungers, e.g., ball plungers. If the slider end stop is weak, the slider will be pulled off the advancing package and will fall onto an ejection ramp.

5 Claims, 6 Drawing Sheets

METHOD FOR CLOSING SLIDER-OPERATED ZIPPER ON FILLED RECLOSABLE POUCH

RELATED PATENT APPLICATION

This application is a divisional of and claims priority from U.S. patent application Ser. No. 10/253,852 filed on Sep. 24, 2002, now U.S. Pat. No. 6,851,248.

BACKGROUND OF THE INVENTION

This invention generally relates to methods and apparatus for manufacturing slider-operated flexible zippers for use in reclosable pouches, bags or other packages of the type in which material, such as foodstuff and detergent, are stored.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged. This may readily be accomplished by forming a plastic bag of a film having the appropriate barrier properties. However, where the bag is provided with a zipper, a problem arises in properly sealing the bag at the opening to be closed by the zipper, since the zipper itself does not provide a hermetic seal.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled structures, portions of which form a fulcrum about which the profiled structures may be pivoted out of engagement when lower edges of the bases are forced towards each other.

One of the important features of such reclosable fastener assemblies is the end stop, which prevents the slider from falling off when the slider reaches the end of the fastener. A slider end stop is provided on each end of the zipper. End stops have taken on various configurations, such as, for example, riveted end clamps such as those described in U.S. Pat. Nos. 5,067,208 and 5,161,286; transverse end stops made from molten material of the fastener strips, as described in U.S. Pat. No. 5,088,971; reciprocating anvils, as described in U.S. Pat. No. 5,131,121; tubular end stops, as described in U.S. Pat. No. 5,405,478; a window structure combined with sealed zipper ends, as described in U.S. Pat. No. 5,442,837; or plastic end clips fused to the zipper as described in U.S. Pat. No. 5,448,807.

U.S. Pat. No. 5,950,285 discloses a reclosable bag having end stops that prevent a slider from moving beyond the end of the zipper when the slider reaches either the closed or fully open position. The end stops are formed from the material of the zipper profiles and "rise vertically" from the zipper to block and prevent further movement of the slider. The end stops are formed by first aligning together the opposing profiles at an end stop area proximate to an end of the bag, and then fusing the zipper profiles at the end stop area to provide a vertical structure for preventing movement of the slider past the ends of the zipper, while at the same time keeping the base of the profiles intact so that the slider cannot lift off of the zipper in the parked position. Preferably, the profiles are fused by directing ultrasonic energy to the end stop areas.

The slider end stop must be designed to withstand the force applied by a consumer during normal use. More specifically, as the consumer pulls the slider to either end of the zipper, the end stop should not bend, fold, collapse or otherwise lose its ability to stop the slider when the slider is pressed against the end stop with the pulling force being exerted by the consumer. The level of force at which the slider overcomes the end stop and slides off the end of the zipper is termed "the pull-off force." It is desirable to test the pull-off resistance of end stops on slider-operated zippers during package manufacturing and to remove packages having defective slider end stops or even shut down the production line so that the end stop forming station can be inspected and the source of the defects evaluated.

As previously described, it is also desirable in many applications to provide means for hermetically sealing the zipper of a reclosable package. There are many known ways of providing a hermetic seal. In one type of reclosable package, the profiled closure members are connected by a membrane that is disposed on the product side of the zipper with the ends of the membrane captured in the side seals of the package. A line of weakening, such as a capped line of perforations of the type disclosed in U.S. Pat. No. 5,023,122, is provided in the zipper membrane. The capped line of perforations or other line of weakening weakens the zipper membrane so that it may be readily ruptured, without detracting from the barrier property of the zipper flange until rupturing actually occurs.

In another type of reclosable package, each zipper half has a respective extension flange depending from and connected to the respective profiled closure members. Typically the upper edges of the front and rear walls of the package are heat sealed to the respective zipper flanges to attach the zipper to the package. The zipper is then hermetically sealed by placing a layer of peel seal material between the opposing zipper flanges along the full length of the zipper and then activating the peel seal by application of heat and pressure. For example, it is known to use a continuous band sealing machine to activate a peel seal.

It is further known to manufacture pouches with slider-operated zippers and to sell those pre-made pouches to a converter, who then fills and seals the pouches. Many converters of pre-made pouches having slider-operated zippers request that the pouches be delivered with the sliders in the open position. The pouches are then filled by hand and placed on a conveyor that takes the filled pouches to a continuous band sealing unit. The band sealer will activate the peel seal layer. There is a need for a device for closing the slider-operated zipper prior to shipment of the filled pouch.

BRIEF DESCRIPTION OF THE INVENTION

The invention is directed to a method and an apparatus for closing open slider-operated zippers on filled packages being conveyed along a production line.

One aspect of the invention is an apparatus for closing a reclosable package having a slider-operated zipper, comprising: spring means that deform elastically when a force greater than a predetermined level is applied; obstructing means coupled to the spring means, the obstructing means having an obstructing state and a non-obstructing state, the obstruction undergoing a transition from the obstructing state to the non-obstructing state when a predetermined level of force is exerted on the spring means; means for causing the package and the obstructing means to translate relative to each other; and means for guiding the slider into contact with the obstructing means during the relative movement of the package and the obstructing means. The obstructing means and the spring means are arranged so that the obstructing means obstruct relative movement of the slider and the obstructing means during the relative movement of the package and the obstructing means, provided that the slider does not exert a force on the obstructing means greater than the predetermined level. The spring means deforms and the obstructing means transitions to the non-obstructing state when the slider exerts a force on the obstructing means greater than the predetermined level.

Another aspect of the invention is an apparatus comprising a band sealer having an in-feed side, means for feeding successive packages on the in-feed side toward and through the band sealer, each package having a slider-operated zipper that is open, and a device, arranged on the in-feed side of the band sealer, for arresting the slider during in-feeding of each successive package. The arresting device causes the slider to close the zipper as the package is fed toward the band sealer.

A further aspect of the invention is an apparatus for closing slider-operated zippers on moving reclosable packages, comprising: a conveyor belt on which the packages are conveyed; opposing drive belts that move at substantially the same speed as the speed of the conveyor belt and engage each package below the zipper on opposing sides thereof; a guideway disposed above the drive belts and comprising a straight channel section shaped to allow passage of a zippered portion of each package, including the slider, therethrough while maintaining the orientation of the slider, and further comprising a vertical slot, in communication with the channel, that allows passage of a portion of each package immediately below the zippered portion; and first and second obstructions respectively movable between extended and retracted positions, wherein the first and second obstructions in the extended positions arrest the slider in the straight channel section until the forces exerted by the slider on the obstructions are sufficient to deflect the first and second obstructions to the retracted positions.

Yet another aspect of the invention is an apparatus comprising: a stationary channel comprising a first section that converges from an entrance end and a second section in communication with the first section and extending to an extend end of the channel, the second section having a profile that generally matches a profile of a slider mounted to a zippered portion of a package; means for transporting the package from a position in front of the entrance end of the channel to a position to the rear of the exit end of the channel along a straight line, the package being disposed during transport in front of the entrance end so that its slider is in a zipper open position and enters the entrance end of the first section of the channel leading the open portion of the zipper; a projection movable between an extended position and a retracted position, the first projection in the extended position projecting into the second section of the channel and into the path of the slider of the package being transported, and the projection in the retracted position not projecting into the second section of the channel; and a spring arranged to resist movement of the projection from the extended position to the retracted position.

A further aspect of the invention is a method for closing a slider-operated zipper on a moving filled package, comprising the following steps: conveying a package forward in a straight line; guiding a slider on a zippered portion of the package through a channel as the package moves forward; blocking forward movement of the slider at a predetermined position inside the channel as the package continues to move forward; and releasing the slider when the force being exerted by the slider in the forward direction reaches a level substantially equal to a predetermined threshold.

Another aspect of the invention is an apparatus for closing a slider-operated zipper on a moving filled package, comprising: means for conveying a package forward in a straight line; means for guiding a slider on a zippered portion of the package through a channel as the package moves forward; and means for blocking forward movement of the slider at a predetermined position inside the channel as the package continues to move forward and then releasing the slider when the force being exerted by the slider in the forward direction reaches a level substantially equal to a predetermined threshold.

Other aspects of the invention are disclosed and claimed below.

DETAILED DESCRIPTION OF THE INVENTION

The present invention is directed to a method and an apparatus for closing an open slider-operated zipper on a reclosable package. Although an embodiment will be hereinafter disclosed that is used in conjunction with a known continuous band sealing unit, the invention is not limited in its application to band sealing operations. The invention may be used in any situation where an open filled package has a slider-operated zipper that needs to be closed, provided that the slider is accessible to the device disclosed below.

Figure 7:
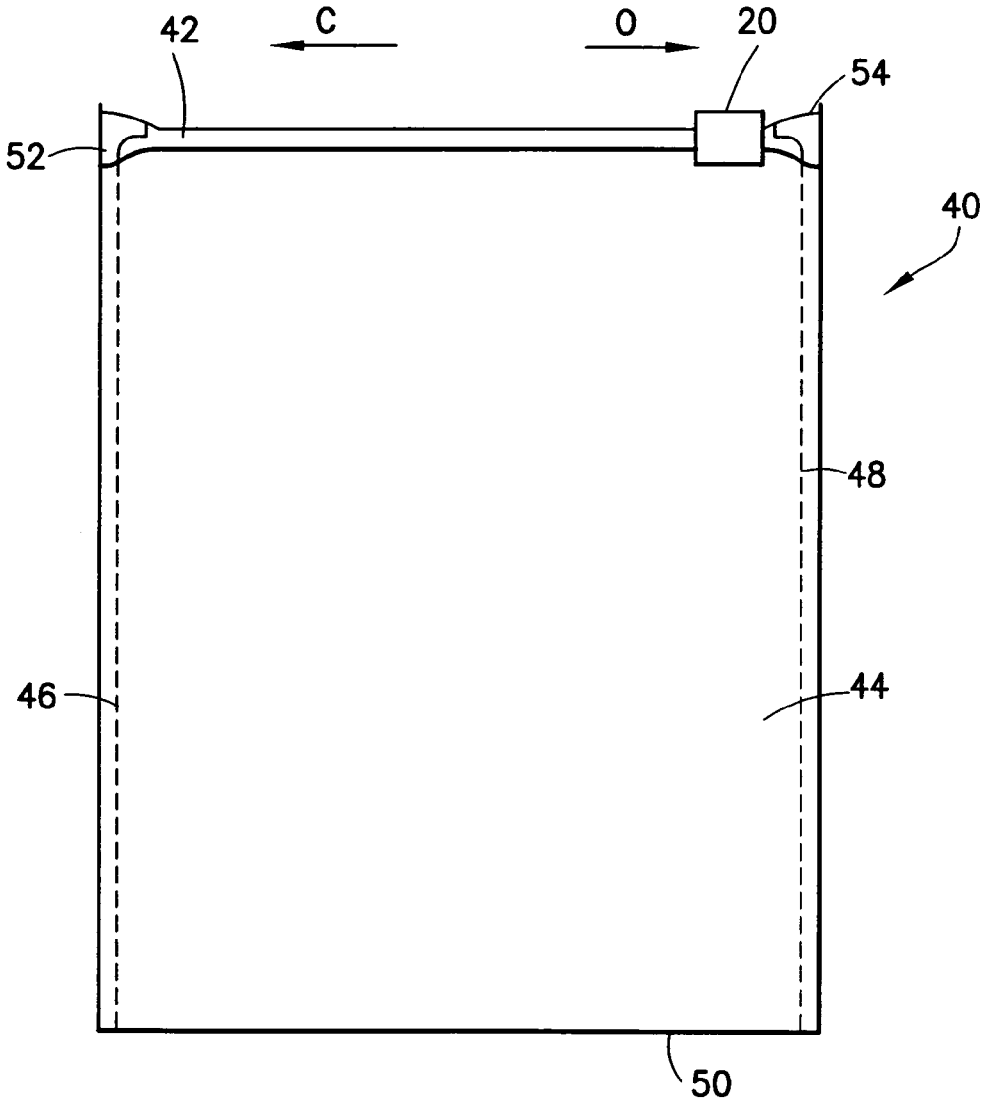
FIG.7 PRIOR ART
FIG. 7 is a drawing showing one type of reclosable package having a slider-operated zipper with slider end stops.

A known reclosable package or bag 40 of a type that can be closed by the device of the present invention is shown in FIG. 7. At its top end, the bag 40 has an openable mouth, on the inside of which is an extruded plastic zipper 42. Zipper 42 is opened and closed by manipulation of a slider 20. The bag shown in FIG. 7 further comprises end stops 52 and 54 for preventing the slider from sliding off the end of the zipper when the slider reaches the closed or fully opened position. Such end stops perform dual functions, serving as stops to prevent the slider from going off the end of the zipper and also holding the two zipper profiles together at the ends.

The bag 40 may be made from any suitable sheet material or plastic film and comprises opposing wall panels (only the front panel 44 is visible in FIG. 7), which may be secured together at opposite side edges of the bag by seams 46 and 48 (indicated by dashed lines). The opposing bottoms of the wall panels may be joined, for example, by means of a seal made in conventional fashion, e.g., by conduction heat sealing. Typically, however, the bottom of the package is formed by a fold 50 in the original packaging film, as seen in FIG. 7.

Figure 8:
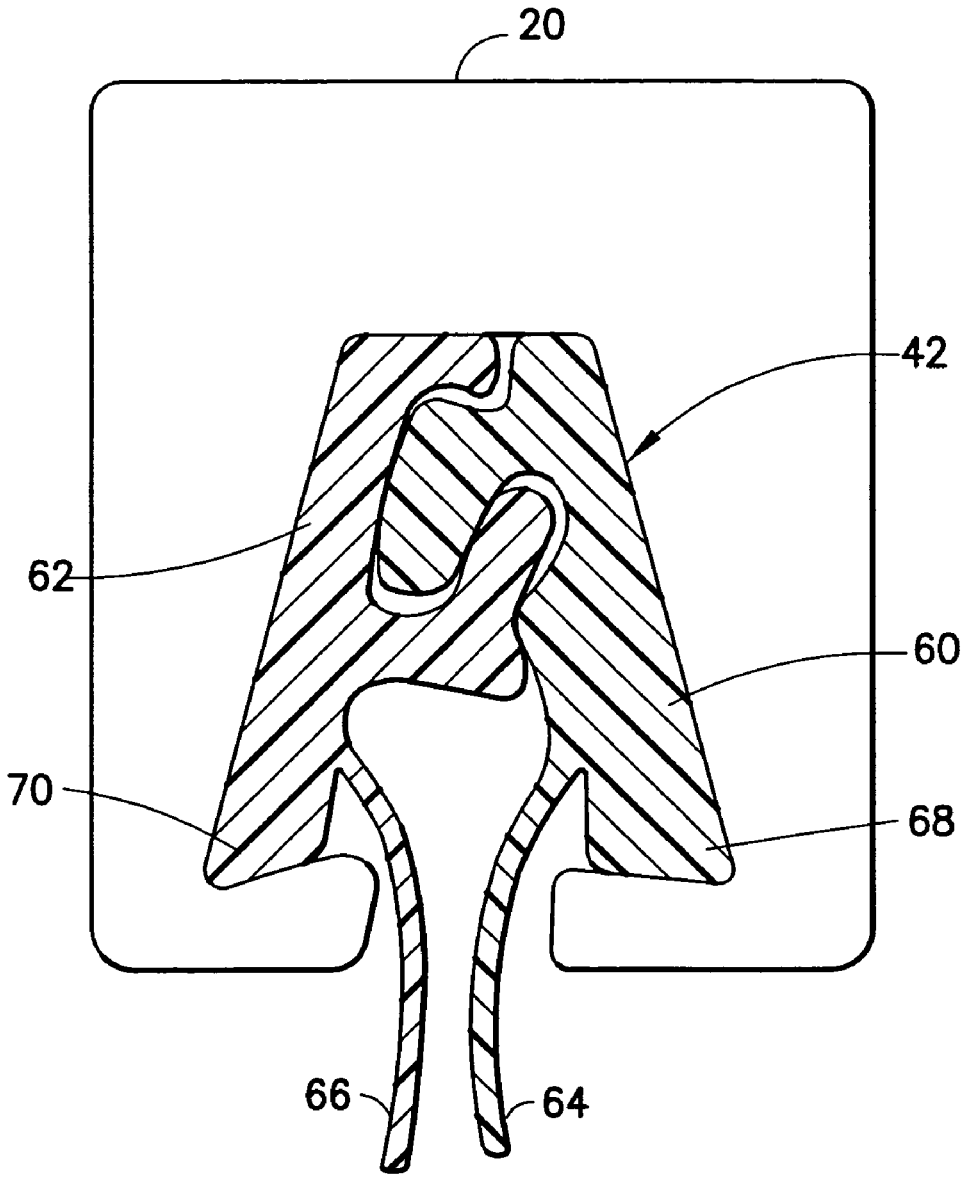
FIG.8 PRIOR ART
FIG. 8 is a drawing showing a sectional view of an interlocked zipper of a known slider-operated plastic zipper with a slider mounted thereto.

FIG. 8 depicts a closing end of the slider 20, with the zipper 42 shown in cross section. The zipper 42 comprises a pair of interlockable closure members 60 and 62. Although rib and groove arrangement is shown for the sake of illustration, the profiles of the closure members may take any form. For example, the zipper may comprise interlocking rib and groove elements or alternating hook-shaped closure elements. The preferred zipper material is polyethylene. The zipper halves further comprise an extension flange 64 connected to the closure member 60 and an extension flange 66 connected to the closure member 62. Although not shown in FIG. 8, the front and rear wall panels of the bag or pouch can be respectively sealed to the extension flanges, e.g., by conduction heat sealing.

In zippered bags with sliders, as the slider moves across the zipper, the zipper is opened or closed. As shown in FIG. 7, the slider 14 is slidable along the zipper in a closing direction "C", causing the zipper halves to become engaged, or in an opening direction "0", causing the zipper halves to become disengaged.

The slider 20 for opening or closing the reclosable zipper is generally shaped so that the slider straddles the zipper profiles, as seen in FIG. 8. The slider may be made in multiple parts and welded together or the parts may be constructed to be snapped together. The slider may also be of one-piece construction. The slider can be made using any desired method, such as injection molding. The slider can be molded from any suitable plastic, such as nylon, delrin, polypropylene, polystyrene, acetal, polyketone, polybutylene terephthalate, high-density polyethylene, polycarbonate, or ABS.

In the case of the particular slider-zipper design depicted in FIG. 8, as the slider 20 is moved in the opening direction, the side walls of the slider push the rails 68 and 70 of the closure members towards each other, the resulting leverage causes the profiled closure members 60 and 62 to pivot oppositely about a fulcrum 72 and disengage from each other. The male profile of closure member 60 is shaped to readily permit easy disengagement from the female profile of closure member 62.

In the specific embodiment of the invention disclosed herein, the zipper closure device acts on a slider of the type shown in FIG. 8 or any other straddling-type slider, i.e., sliders without a separating finger.

Some customers who purchase pre-made slider/zippered pouches and then fill them with product request that the pouches be shipped to them with the slider in the open position. They then manually fill each pouch and set it on a conveyor that carries the pouch to the continuous band sealing unit, where the peel seal is activated. A device is needed for closing the package after it has been filled.

Figure 1:
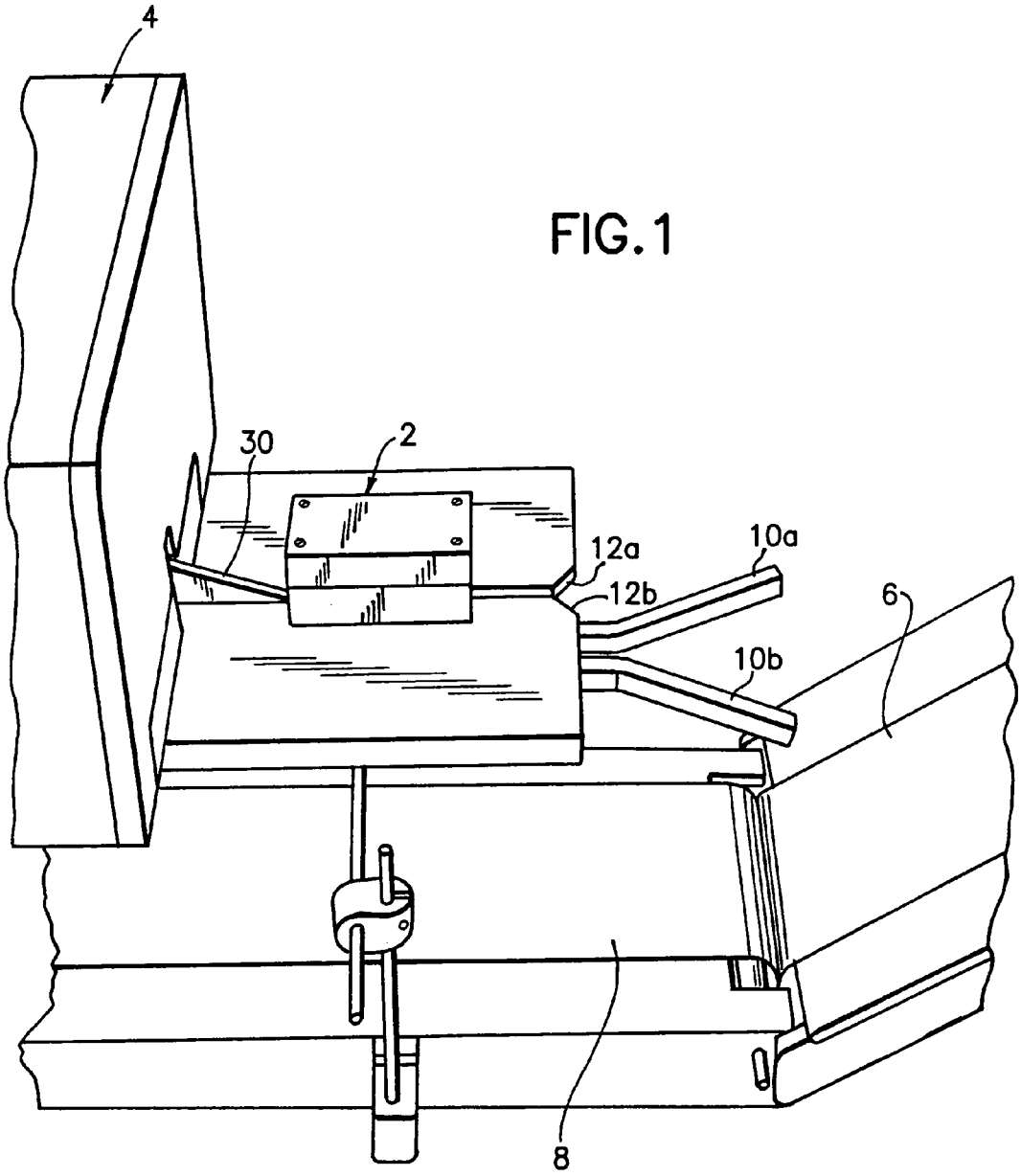
FIG. 1 is a drawing showing one view of a continuous band sealing machine having a device for closing the slider-operated zipper on an incoming pouch in accordance with one embodiment of the invention.

A zipper closure device 2 in accordance with one embodiment of the invention is attached to the in-feed side of a continuous band sealing unit 4, as shown in FIG. 1. Filled packages slide down a chute 6 and land on a moving conveyor belt 8. The conveyor belt 8 carries the packages in a forward direction. A pair of guide rails 10*a* and 10*b*, disposed above the conveyor belt 8, comprise converging portions that form a V shape and mutually parallel portions that form a gap therebetween. The V-shaped portion tracks the pouch into the band sealing unit by guiding the upright portion of the filled package toward the gap between the parallel portions of the guide rails. Each guide rail comprises a metal base that holds a plastic rod on the inside. The package contacts the plastic rods only.

As the filled package continues to be advanced by the conveyor belt 8, an intermediate portion of the upright package above the product line enters another gap formed by a pair of mounting plates 12*a* and 12*b*. The plates are rounded at the entrance of the gap to eliminate snagging of the package as it enters the gap. The mounting plates 12*a* and 12*b* are disposed in a generally horizontal plane at an elevation higher than that of the guide rails 10*a* and 10*b* (see FIG. 2). The zipper closure device 2 is mounted on top of the mounting plates 12*a* and 12*b*, spanning the gap therebetween. At the exit end of the zipper closure device 2, a zipper guide 30 is provided. The zipper guide 30 comprises a pair of spaced parallel plates comprising a ramped section and a horizontal straight section, the latter providing a pair of parallel straight edges on which the zipper profiles are supported as the package enters the band sealing unit 4.

Figure 2:
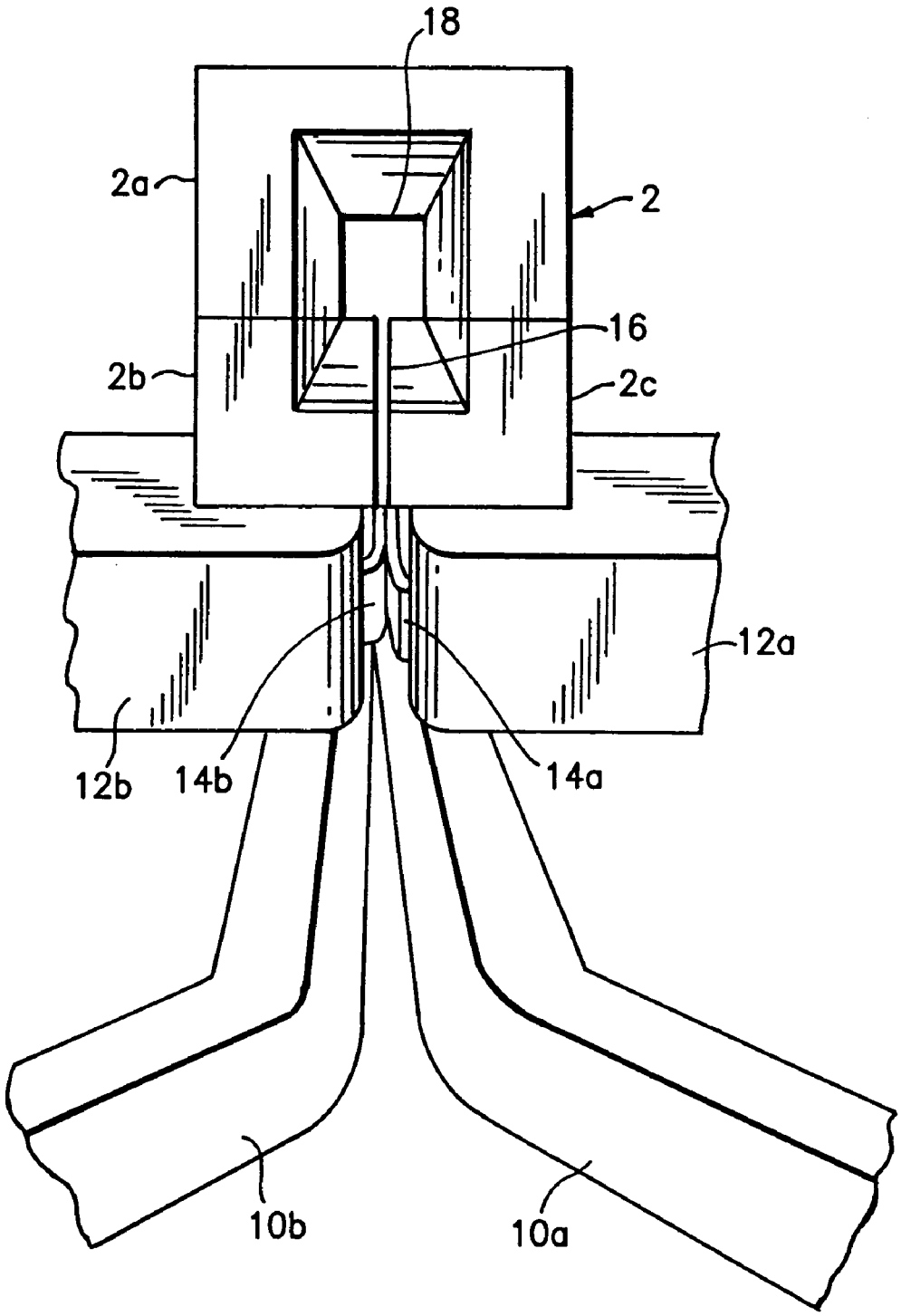
FIG. 2 is a drawing showing another view of the same machine shown in FIG. 1.

As seen in FIG. 2, the gap between the mounting plates 12*a* and 12*b* overlies the gap between the guide rails 10*a* and 10*b*. A pair of opposing drive belts 14*a* and 14*b* are placed with their opposing belt portions vertically disposed in a plane that generally bisects the gap between the mounting plates 12*a* and 12*b*. Each drive belt is supported by the same number of pulleys, the axes of rotation of the pulleys supporting belt 14*a* being disposed in a first vertical plane and the axes of rotation of the pulleys supporting belt 14*b* being disposed in a second vertical plane, the first and second planes being mutually parallel. As a result, the drive belts 14*a* and 14*b* form a nip that extends in a vertical plane. The drive belts 14*a* and 14*b* rotate at the same speed in opposite directions such that the opposing belt portions in the nip move in the forward direction at substantially the same speed as the top portion of the conveyor belt 8.

The zipper closure device 2 has a vertical slot 16 that overlies the gap between the mounting plates 12*a* and 12*b*. The width of the slot is less than the width of the zipper profile, but wide enough to allow the portion of the package where the zipper flanges lie to pass through. The zipper closure device 2 further comprises a horizontal longitudinal channel 18 that communicates with the top of the vertical slot 16. The channel 18 has a profile that is shaped to allow the slider to pass through while maintaining the orientation and elevation of the slider substantially constant during slider passage. The slider enters the channel 18 with its opening end leading.

The vertical plane of the drive belt nip is generally aligned with the vertical slot 16 of the zipper closure device 2 and overlies the gap between the guide rails 10*a* and 10*b*. This arrangement provides clearance for the uppermost part of the filled package to pass through, with the slider and zipper profiles passing through the channel 18 while the opposing walls of the package in the area below the zipper profiles passes through the slot 16 and the nip of the drive belts 14*a* and 14*b*. The drive belts carry the pouch through the zipper closure device 2 and through the band sealing unit 4. The drive belts can be made of Teflon, which is a trade name for a polymer of polytetrafluoroethylene, a tough, heat-resistant fluorocarbon resin.

Figure 3:
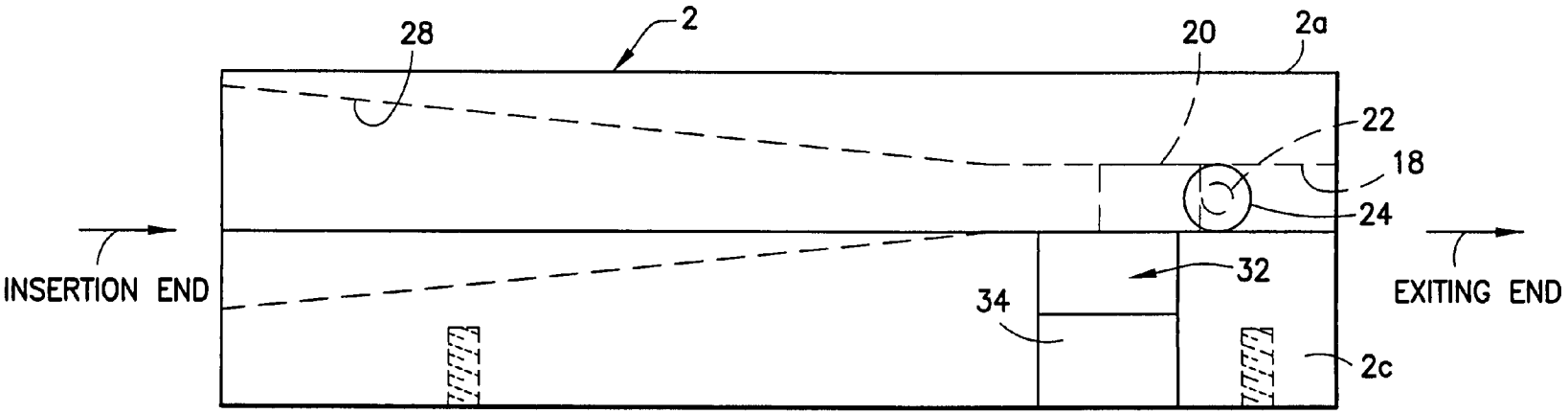
FIG. 3 is a drawing showing a side view of the zipper closure device incorporated in the machine depicted in FIGS. 1 and 2.
Figure 5:
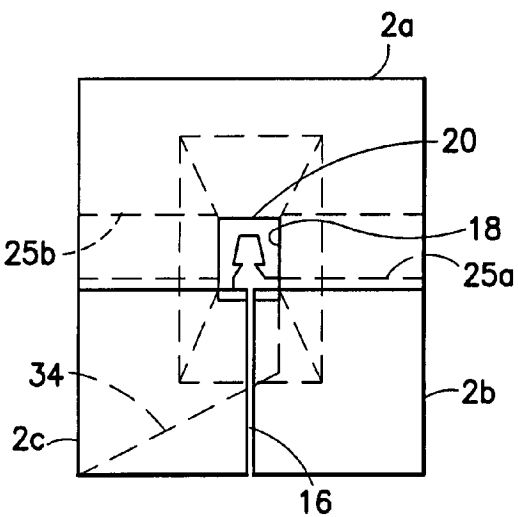
FIG. 5 is a drawing showing a view of the exit end of the zipper closure device depicted in FIG. 3.
Figure 4:
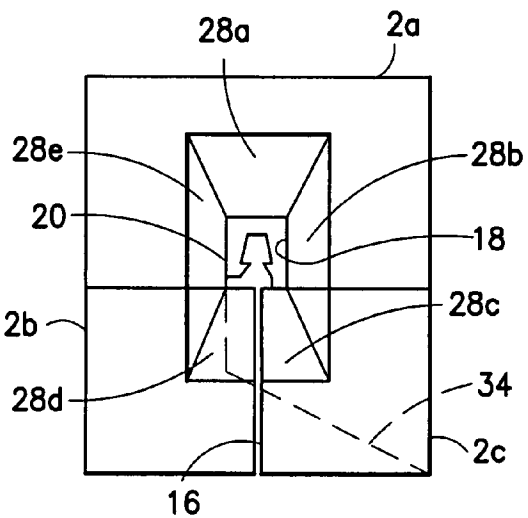
FIG. 4 is a drawing showing a view of the entrance end of the zipper closure device depicted in FIG. 3.

The zipper closure device 2 is shown in greater detail in FIGS. 3–5. FIG. 3 is a side view, while FIG. 4 shows the end where the slider (clipped on the zipper profiles in an open position) enters and FIG. 5 shows the end where the slider (clipped on the zipper profiles in the closed position) exits. Each of FIGS. 3–5 shows a slider 20 inside the channel 18 without the zipper or package walls being depicted to avoid complication. Although the profile of the slider depicted in FIGS. 4 and 5 differs from the slider profile seen in FIG. 2 in that one leg is longer than the other, the principle of operation of the present invention is the same in either case.

As best seen in FIG. 3, the zipper closure device 2 comprises a converging channel 28 that communicates with the horizontal straight channel 18 for guiding a slider into the straight channel. The converging channel 28 and straight channel 18 form a guideway that may be considered to be a single channel having converging and straight sections. The converging channel section 28 has a cross-sectional area that gradually decreases from the slider insertion end to an intermediate point and the straight channel section 18, extending from the aforementioned intermediate point to the exit end, has a profile that is substantially constant from the intermediate to a point near the exit end.

The embodiment of the zipper closure device 2 shown in FIGS. 3–5 comprises three parts respectively labeled 2*a*, 2*b* and 2*c*. As best seen in FIG. 4, lower parts 2*b* and 2*c* of the guideway are spaced apart at opposing mutually parallel surfaces that form the vertical slot 16. The slot 16 has a width less than the maximum width of the zipper profile. The upper part 2*a* of the guideway comprises three of the surfaces that form the straight channel section 18, the fourth side of the channel being formed by respective surfaces on the lower parts 2*b* and 2*c* of the guideway. The surfaces of the converging channel section are distributed over the three parts as seen in FIG. 4. The end result is four trapezoidal planar surfaces with long bases at the insertion end of the guideway and short bases at the aforementioned intermediate point (bearing in mind that the fourth trapezoidal surface is bisected by the vertical slot 16). The trapezoidal surfaces are disposed such that the decreasing cross-sectional area of the converging channel section is a rectangle.

The three parts 2*a*–2*c* form a block with channel 28/18 and vertical slot 16 each extending along the entire length of the block. In a prototype, the three parts were made of Delrin, which is a trade name for a highly crystalline homopolymer acetal resin that is rigid and hard. However, other materials can be used.

The converging channel section 28 guides the incoming slider into the straight channel section 18. The vertical slot 16 holds the uppermost portion of the package upright with the slider oriented with its opening end leading as the package enters the guideway. The package is advanced continuously by the above-described drive belts, causing the slider to travel down the straight channel section 18. However, the slider is arrested when its leading end abuts a pair of balls 22 (only one of which is indicated by a dashed circle in FIG. 3), which project into the channel section 18 to a degree that further travel of the slider 20 is obstructed. The slider 20 is shown (by dashed lines) in FIG. 3 in its arrested position.

As shown in FIG. 5, the upper part 2*a* has a pair of coaxial threaded bores 25*a* and 25*b* that communicate with the straight channel section 18 on opposite sides thereof. Respective ball plungers (the casing 24 of one of which is indicated in FIG. 3) are threadably coupled in the threaded bores 25*a* and 25 with the balls 22 of the plungers partly projecting into the channel section 18 in direct opposition to each other. Alternatively, spring plungers comprising rods with rounded tips that project into the slider guide channel can be utilized.

When the zippered portion of the pouch passes through the straight channel section 18, the slider is in the open position. Holding the slider stationary at the ball plungers while the zippered pouch is moved forward by the drive belts and the conveyor belt causes the slider to move in a closing direction relative to the zipper, thereby closing the zipper before the pouch enters the band sealing unit 4.

Figure 6:
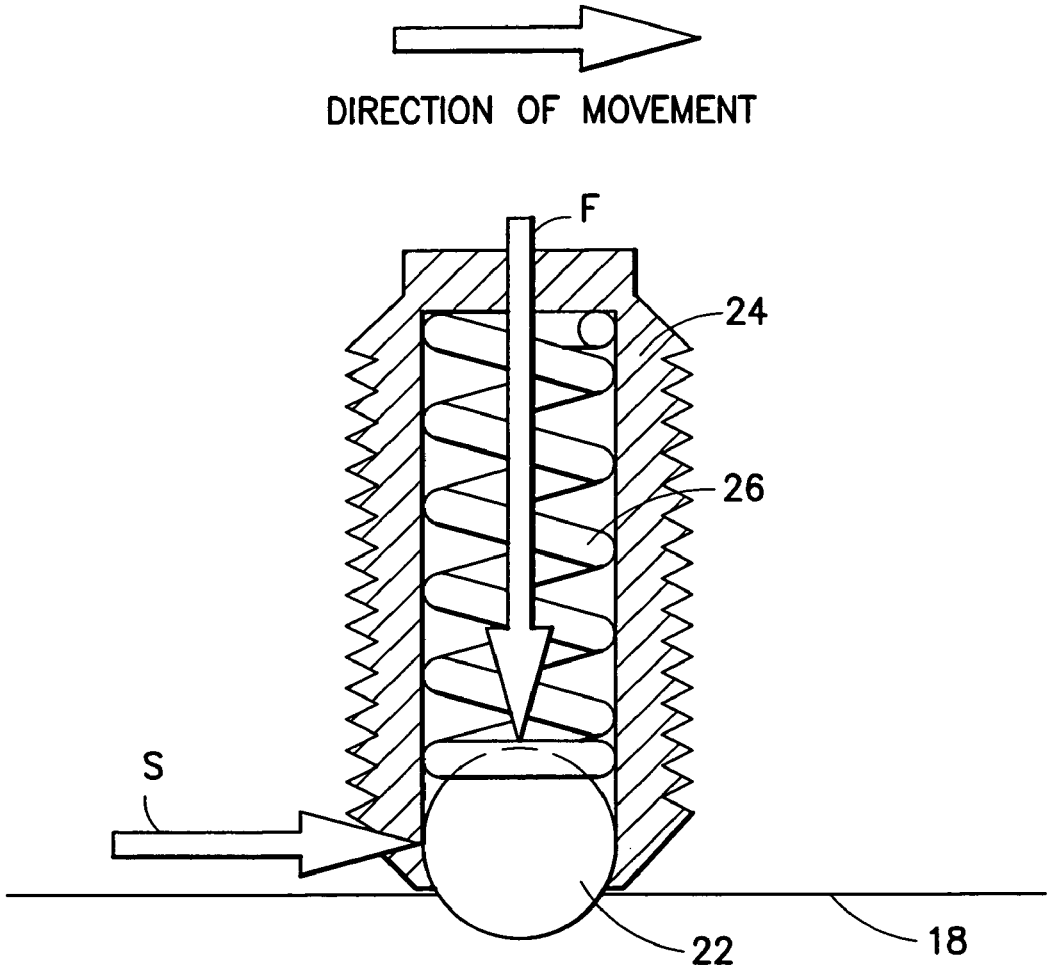
FIG. 6 is a drawing showing a sectional view of a conventional ball plunger of the type used in the disclosed embodiment.

The structure of one type of ball plunger suitable for use in the present invention is shown in FIG. 6. The ball plunger comprises a cylindrical casing 24 that has a threaded exterior and a smooth circular bore that is closed at one end. A compression spring 26 is installed inside the circular cylindrical bore with one end of the spring seated against the closed end of the bore. The other end of the spring pushes against a ball 22, which is held in the circular cylindrical bore by inwardly tapered distal portions of the casing 24 that form a detect hole. The distal portion of the casing is designed to allow the ball 22 to seat against curved surfaces that prevent the ball from leaving the bore and yet allow a portion of the ball to project through the detent hole of the casing and into the channel 18, as seen in FIG. 6. An identical ball plunger is provided on the other side of channel 18, so that a pair of opposing balls project into the channel and obstruct passage of the slider. However, the balls are retractable provided that sufficient side force is exerted on the balls to cause the springs to compress. The level of side force needed to slide a ball out of its detent hole is a function of how far the spring 26 will be depressed, which depends on how far away from the channel surface the ball projects. This in turn is determined by the position of the casing 24, which can be adjusted by screwing the casing further into or out of the threaded bore 25 in the guideway.

Thus, the positions of the ball plungers can be adjusted so that the opposing balls retract to respective non-obstructing positions when the side forces exerted by the slider on the balls are equal to a sufficiently high force (selected to correspond to a minimum acceptable pull-off resistance) that does not result in the slider being pulled off the end of the zipper. The force exerted by the slider on the balls is due to the lagging end stop pushing against the closing end of the arrested slider while the pouch continues to advance. When the side forces exerted by the slider on the balls reach the pre-adjusted level without the end stop failing, the balls will be pushed out of the way and the slider will pass through the straight channel section 18.

Conversely, if the end stop fails and the slider never exerts a side forces equal to the pre-adjusted levels, the zippered portion of the pouch will pass through while the obstructed slider is pulled off the end of the zipper. Directly underneath the arrested slider position, the channel 18 communicates with a slider ejection passageway 32 (see FIG. 3) formed in the lower parts 2*b* and 2*c* of the guideway. The lower parts 2*b* and 2*c* further comprises respective portions of an inclined slider ejection ramp 34 disposed along a terminal section of the slider ejection passageway. Thus a pulled-off slider can be ejected and directed to a catch basin (not shown) by the ejection ramp.

The device described above enables the closure of filled slider-zippered packages, while at the same testing the pull-off resistance of those sliders. The device is especially well suited for use with slider that do not have a separating finger. The use of spring-loaded obstructions enables the system operator to adjust the amount of force exerted by the slider that will snap the obstructions out of the way. This allows the obstructing fingers or balls to restrain the slider and eject it in the event there is a weak or below minimum pull-off slider end stop. Another benefit of the disclosed device is that it increases the accuracy of a more horizontal or level heat seal across the horizontal peel seal strip between the zipper flanges by using the slider as a means of leveling the zippered part of the pouch.

The embodiment described above comprises a stationary zipper closure device and a moving package. However, the person skilled in the art will recognize that the concept of the invention will also work if the package is held stationary while the zipper closure device is moved. The principle of the invention is that the slider be obstructed during its transit along a channel. Relative movement of the slider and the obstructed channel can be achieved by moving the slider through a stationary channel, by moving the channel over the slider of a stationary package, or by moving the slider and channel in opposite directions with the slider inside the channel.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the term "spring-loaded plunger" includes ball plungers, spring plungers, and any other device capable of overcoming and moving in opposition to a spring force in response to application of a side force in excess of a predetermined level. As used in the claims, the term "block" encompasses both monolithic bodies and bodies comprising an assembly of parts.

What is claimed is:

1. A method for closing a slider-operated zipper on a moving filled package, comprising the following steps:

conveying a filled package forward in a straight line, the package comprising an open zipper having an exposed slider mounted thereto;

guiding the exposed slider into a stationary channel as the filled package moves forward;

blocking forward movement of the slider at a predetermined position inside the channel so that the moving zipper is gradually closed by the stationary slider as the package continues to move forward; and releasing the slider when a force being exerted by the slider in the forward direction reaches a level equal to at least a minimum acceptable pull-off resistance.

2. The method as recited in claim 1, further comprising the step of band sealing the package at an elevation below the elevation of the slider after said releasing step and while the package continues to move forward.

3. The method as recited in claim 1, wherein the slider is blocked by a pair of obstructions that displace to non-blocking positions when the force exerted by the obstructions on the slider in a rearward direction equals at least said minimum acceptable pull-off resistance.

4. A method for testing the pull-off resistance of a slider mounted to a zipper on a filled reclosable package, comprising the following steps:

conveying a filled package forward in a straight line, the package comprising an open zipper having an exposed slider of a type not having a separating finger mounted thereto and comprising two zipper strips joined at their respective opposing ends;

guiding the exposed slider into a stationary channel as the filled package moves forward; and blocking forward movement of the slider at a predetermined position inside the channel so that the moving zipper is gradually closed by the stationary slider and is then pulled off of the lagging end of the moving zipper when the actual resistance to such pull off offered by the lagging end of the moving zipper is overcome.

5. The method as recited in claim 4, further comprising the step of directing the pulled-off slider to a catch basin as it falls under the influence of gravity.

* * * * *